US009048014B2

(12) United States Patent
Ozeki et al.

(10) Patent No.: US 9,048,014 B2
(45) **Date of Patent: *Jun. 2, 2015**

(54) PERMANENT MAGNET AND MANUFACTURING METHOD THEREOF

(75) Inventors: Izumi Ozeki, Ibaraki (JP); Katsuya Kume, Ibaraki (JP); Keisuke Hirano, Ibaraki (JP); Tomohiro Omure, Ibaraki (JP); Keisuke Taihaku, Ibaraki (JP); Toshinobu Hoshino, Ibaraki (JP); Takashi Ozaki, Ibaraki (JP)

(73) Assignee: NITTO DENKO CORPORATION, Osaka (JP)

( * ) Notice: Subject to any disclaimer, the term of this patent is extended or adjusted under 35 U.S.C. 154(b) by 254 days.

This patent is subject to a terminal disclaimer.

(21) Appl. No.: 13/499,457

(22) PCT Filed: Mar. 28, 2011

(86) PCT No.: PCT/JP2011/057567

§ 371 (c)(1),
(2), (4) Date: Mar. 30, 2012

(87) PCT Pub. No.: WO2011/125586

PCT Pub. Date: Oct. 13, 2011

(65) Prior Publication Data

US 2012/0187326 A1 Jul. 26, 2012

(30) Foreign Application Priority Data

Mar. 31, 2010 (JP) ..... 2010-084293

(51) Int. Cl.
*H01F 1/057* (2006.01)
*C22C 33/02* (2006.01)
(Continued)

(52) U.S. Cl.
CPC ..... *H01F 1/0572* (2013.01); *C22C 33/0278* (2013.01); *C22C 2202/02* (2013.01);
(Continued)

(58) Field of Classification Search
CPC ..... H01F 1/0572; H01F 1/0577; H01F 1/086
USPC ..... 252/62.51 R, 62.57, 62.55
See application file for complete search history.

(56) References Cited

U.S. PATENT DOCUMENTS 4,762,574 A * 8/1988 Ghandehari ..... 148/103
7,608,153 B2 * 10/2009 Tayu et al. ..... 148/302
(Continued)

FOREIGN PATENT DOCUMENTS

CN 1171313 A 1/1998
CN 101031984 A 9/2007
(Continued)

OTHER PUBLICATIONS

Notification of the First Office Action issued in counterpart CN Application No. 201180003924.10 dated Oct. 29, 2012.
(Continued)

*Primary Examiner* — Matthew E Hoban
(74) *Attorney, Agent, or Firm* — Sughrue Mion, PLLC

(57) ABSTRACT

There are provided a permanent magnet and a manufacturing method thereof capable of decreasing an activity level of a calcined body activated by a calcination process. To fine powder of milled neodymium magnet is added an organometallic compound solution containing an organometallic compound expressed with a structural formula of $M-(OR)_x$ (M represents Dy or Tb, R represents a substituent group consisting of a straight-chain or branched-chain hydrocarbon, $_x$ represents an arbitrary integer) so as to uniformly adhere the organometallic compound to particle surfaces of the neodymium magnet powder. Thereafter, desiccated magnet powder is held for several hours in hydrogen atmosphere at 200 through 900 degrees Celsius. Thereafter, the powdery calcined body calcined through the calcination process in hydrogen is held for several hours in vacuum atmosphere at 200 through 600 degrees Celsius for a dehydrogenation process. Thereafter, through powder compaction and sintering process, the powdery calcined body is formed into a permanent magnet.

4 Claims, 14 Drawing Sheets

(51) Int. Cl.
*H01F 1/08* (2006.01)
*H01F 41/02* (2006.01)
*C22C 1/02* (2006.01)

(52) U.S. Cl.
CPC ..... *H01F1/0577* (2013.01); *H01F 1/086* (2013.01); *H01F 41/0266* (2013.01); *H01F 41/0293* (2013.01); *C22C 1/02* (2013.01)

(56) References Cited

U.S. PATENT DOCUMENTS

| | | | | |
|---|---|---|---|---|
| 2004/0000359 | A1* | 1/2004 | Tayu et al. | 148/302 |
| 2005/0133117 | A1 | 6/2005 | Tayu et al. | |
| 2009/0053094 | A1 | 2/2009 | Morimoto et al. | |
| 2011/0018664 | A1 | 1/2011 | Ozeki et al. | |
| 2011/0267160 | A1 | 11/2011 | Ozeki et al. | |
| 2012/0181475 | A1* | 7/2012 | Ozeki et al. | 252/62.51 R |

FOREIGN PATENT DOCUMENTS

| | | | | |
|---|---|---|---|---|
| JP | 07-211570 | A | | 6/1995 |
| JP | 07-263265 | | | 10/1995 |
| JP | 10-064746 | A | | 3/1998 |
| JP | 10-214711 | A | | 8/1998 |
| JP | 3298219 | B2 | | 4/2002 |
| JP | 2005-191187 | | * | 7/2005 |
| JP | 2005-191187 | A | | 7/2005 |
| JP | 2009-259956 | | | 11/2009 |
| WO | 2009/116532 | A1 | | 9/2009 |
| WO | WO 2009/116532 | A1 | | 9/2009 |

OTHER PUBLICATIONS

Supplementary European Search Report issued in Application No. 11765486.3 dated Jan. 3, 2013.

* cited by examiner

FIG. 8

| | M | OR | CALCINATION | CARBON CONTENT (wt%) |
|---|---|---|---|---|
| EMBODIMENT 1 | Dy | n-PROPOXIDE | YES | 0.17 |
| EMBODIMENT 2 | Dy | ETHOXIDE | YES | 0.16 |
| EMBODIMENT 3 | Tb | ETHOXIDE | YES | 0.16 |
| COMPARATIVE EXAMPLE 1 | Dy | n-PROPOXIDE | NO | 0.20 |
| COMPARATIVE EXAMPLE 2 | Tb | ETHOXIDE | NO | 0.27 |
| COMPARATIVE EXAMPLE 3 | Dy | ACETYLACETONATE | YES | 0.28 |

ADDITIVE M-(OR)x

EMBODIMENT 1

EMBODIMENT 1

EMBODIMENT 2

EMBODIMENT 3

EMBODIMENT 3

COMPARATIVE EXAMPLE 1

COMPARATIVE EXAMPLE 2

COMPARATIVE EXAMPLE 3

PERMANENT MAGNET AND MANUFACTURING METHOD THEREOF

CROSS REFERENCE TO RELATED APPLICATIONS

This application is a National Stage of International Application No. PCT/JP2011/057567 filed Mar. 28, 2011, claiming priority based on Japanese Patent Application No. 2010-084293 filed Mar. 31, 2010, the contents of all of which are incorporated herein by reference in their entirety.

TECHNICAL FIELD

The present invention relates to a permanent magnet and manufacturing method thereof.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, a further improvement in magnetic performance is required of a permanent magnet to be buried in the permanent magnet motor. Meanwhile, as permanent magnet, there have been known ferrite magnets, Sm—Co-based magnets, Nd—Fe—B-based magnets, $Sm_2Fe_{17}N_x$-based magnets or the like. As permanent magnet for permanent magnet motor, there are typically used Nd—Fe—B-based magnets among them due to remarkably high residual magnetic flux density.

As method for manufacturing a permanent magnet, a powder sintering process is generally used. In this powder sintering process, raw material is coarsely milled first and furthermore, is finely milled into magnet powder by a jet mill (dry-milling) method. Thereafter, the magnet powder is put in a mold and pressed to form in a desired shape with magnetic field applied from outside. Then, the magnet powder formed and solidified in the desired shape is sintered at a predetermined temperature (for instance, at a temperature between 800 and 1150 degrees Celsius for the case of Nd—Fe—B-based magnet) for completion.

PRIOR ART DOCUMENT

Patent Document

Patent document 1: Japanese Registered Patent Publication No. 3298219 (pages 4 and 5)

DISCLOSURE OF THE INVENTION

Problem to Be Solved by the Invention

On the other hand, as to Nd-based magnets such as Nd—Fe—B magnets, poor heat resistance is pointed to as defect. Therefore, in case a Nd-based magnet is employed in a permanent magnet motor, continuous driving of the motor brings the magnet into gradual decline of residual magnetic flux density and irreversible demagnetization. Then, in case of employing a Nd-based magnet in a permanent magnet motor, in order to improve heat resistance of Nd-based magnet, Dy (dysprosium) or Tb (terbium) having high magnetic anisotropy is added in attempt to further improve coercive force.

As method for adding Dy or Tb, there have been conventionally known two methods: a grain boundary diffusion method such that Dy or Tb is made to be put on a surface of a sintered magnet so as to be diffused; and a two-alloys method such that two types of powder corresponding to a main phase and a grain boundary phase are separately made and thereafter mixed (dry blending). Those methods have their own defects. The former method is effective for magnets in flat shape or in fragments, but in a form of a large-sized magnet, a diffusion length of Dy or Tb cannot be extended to a grain boundary phase formed inside. In the latter method, magnets are made by blending and pressing the two alloys, which results in diffusion of Dy or Tb in grains and failure to get Dy or Tb concentrated in grain boundaries.

Further, Dy or Tb is rare metal and producing regions are limited. It is therefore preferable to curtail even small amount of Dy or Tb to be used with respect to that of Nd. Furthermore, as problem, addition of large amount of Dy or Tb lowers residual magnetic flux density which represents magnet intensity. Thus, there has been desired art to efficiently concentrate traces of Dy or Tb in grain boundaries so as to significantly improve coercive force of a magnet without decline of residual magnetic flux density.

Further, it would be practicable to add Dy or Tb in a state of being distributed in an organic solvent, to a Nd-based magnet so as to concentrate Dy or Tb in grain boundaries of the magnet. Generally speaking, however, once an organic solvent is added to a magnet, carbon-containing substances remain in the magnet even if the organic solvent is later volatilized by vacuum drying or the like. It has been previously well known that in case where carbon-containing substances remain in a Nd-based magnet, the magnet is adversely affected when sintered. Specifically, since Nd and carbons exhibit significantly high reactivity therebetween, carbon-containing substances form carbide when remaining up to high-temperature stage in a sintering process. Consequently, the carbide thus formed makes a gap between a main phase and a grain boundary phase of the sintered magnet and accordingly the entirety of the magnet cannot be sintered densely, which causes a problem of serious degrade in the magnetic performance. Even if the gap is not made, the secondarily-formed carbide makes alpha iron separated out in the main phase of the sintered magnet, which causes a problem of serious degrade in the magnetic properties. In this regard, it is practicable to use the art of calcining the magnet in hydrogen atmosphere before sintering so as to thermally decompose the carbon-containing substances and burn off contained carbon. However, $NdH_3$ having high activity level is created in the Nd-based magnet calcined through the calcination process in hydrogen as above described, which indicates a problematic tendency to combine with oxygen.

The present invention has been made to resolve the above described conventional problem and the object thereof is to provide a permanent magnet and manufacturing method thereof capable of: efficiently concentrating traces of Dy or Tb contained in an organometallic compound on grain boundaries of the magnet; and decreasing activity level with respect to the calcined body activated by a calcination process so that resultant magnet particles are prevented from combining with oxygen and decline in residual magnetic flux density and coercive force can be prevented.

Means for Solving the Problem

To achieve the above object, the present invention provides a permanent magnet manufactured through steps of: milling magnet material into magnet powder; adding an organometallic compound expressed with a structural formula of $M-(OR)_x$ (M representing Dy or Tb, R representing a substituent group consisting of a straight-chain or branched-chain hydrocarbon, and $_x$ representing an arbitrary integer) to the magnet powder obtained at the step of milling magnet material and getting the organometallic compound adhered to particle surfaces of the magnet powder; calcining the magnet powder of which particle surfaces have got adhesion of the organometallic compound in hydrogen atmosphere so as to obtain a calcined body; performing a dehydrogenation process by applying heat to the calcined body in vacuum atmosphere; compacting the calcined body after the dehydrogenation process so as to obtain a compact body; and sintering the compact body.

In the above-described permanent magnet of the present invention, metal contained in the organometallic compound is concentrated in grain boundaries of the permanent magnet after sintering.

In the above-described permanent magnet of the present invention, R in the structural formula is an alkyl group.

In the above-described permanent magnet of the present invention, R in the structural formula is an alkyl group of which carbon number is any one of integer numbers 2 through 6.

In the above-described permanent magnet of the present invention, residual carbon content after sintering is under 0.2 wt %.

In the above-described permanent magnet of the present invention, in the step of calcining the magnet powder, the magnet powder is held for predetermined length of time within a temperature range between 200 and 900 degrees Celsius.

In the above-described permanent magnet of the present invention, in the step of performing the dehydrogenation process, the magnet powder is held for predetermined length of time in vacuum atmosphere within a temperature range between 200 and 600 degrees Celsius.

To achieve the above object, the present invention further provides a manufacturing method of a permanent magnet comprising steps of: milling magnet material into magnet powder; adding an organometallic compound expressed with a structural formula of $M-(OR)_x$ (M representing Dy or Tb, R representing a substituent group consisting of a straight-chain or branched-chain hydrocarbon, and $_x$ representing an arbitrary integer) to the magnet powder obtained at the step of milling magnet material and getting the organometallic compound adhered to particle surfaces of the magnet powder; calcining the magnet powder of which particle surfaces have got adhesion of the organometallic compound in hydrogen atmosphere so as to obtain a calcined body; performing a dehydrogenation process by applying heat to the calcined body in vacuum atmosphere; compacting the calcined body after the dehydrogenation process so as to obtain a compact body; and sintering the compact body;

In the above-described manufacturing method of permanent magnet of the present invention, R in the structural formula is an alkyl group.

In the above-described manufacturing method of permanent magnet of the present invention, R in the structural formula is an alkyl group of which carbon number is any one of integer numbers 2 through 6.

In the above-described manufacturing method of permanent magnet of the present invention, in the step of calcining the magnet powder, the magnet powder is held for predetermined length of time within a temperature range between 200 and 900 degrees Celsius.

In the above-described manufacturing method of permanent magnet of the present invention, in the step of performing the dehydrogenation process, the magnet powder is held for predetermined length of time in vacuum atmosphere within a temperature range between 200 and 600 degrees Celsius.

Effect of the Invention

According to the permanent magnet of the present invention, traces of Dy or Tb contained in the organometallic compound that has been added to the magnet can be efficiently concentrated in grain boundaries of the magnet. Further, by performing dehydrogenation process after calcination, activity level is decreased with respect to the calcined body activated by the calcination process. Thereby, the resultant magnet particles are prevented from combining with oxygen and the decrease in the residual magnetic flux density and coercive force can also be prevented.

According to the permanent magnet of the present invention, Dy or Tb having high magnetic anisotropy gets concentrated in grain boundaries of the sintered magnet. Therefore, coercive force can be improved by Dy or Tb, concentrated at the grain boundaries, preventing a reverse magnetic domain from being generated in the grain boundaries. Further, since amount of Dy or Tb added thereto is less in comparison with conventional amount thereof, decline in residual magnetic flux density can be avoided.

According to the permanent magnet of the present invention, the organometallic compound consisting of an alkyl group is used as organometallic compound to be added to magnet powder. Therefore, thermal decomposition of the organometallic compound can be caused easily when the magnet powder is calcined in hydrogen atmosphere. Consequently, carbon content in the calcined body can be reduced more reliably.

According to the permanent magnet of the present invention, the organometallic compound consisting of an alkyl group of which carbon number is any one of integer numbers 2 through 6 is used as organometallic compound to be added to magnet powder. Therefore, the organometallic compound can be thermally decomposed at low temperature when the magnet powder is calcined in hydrogen atmosphere. Consequently, thermal decomposition of the organometallic compound can be caused more easily in the entirety of the magnet powder. In other words, carbon content in the calcined body can be reduced more reliably through a calcination process.

According to the permanent magnet of the present invention, the residual carbon content after sintering is under 0.2 wt %. This configuration avoids occurrence of a gap between a main phase and a grain boundary phase, places the entirety of the magnet in densely-sintered state and makes it possible to avoid decline in residual magnetic flux density. Further, this configuration prevents considerable alpha iron from separating out in the main phase of the sintered magnet so that serious deterioration of magnetic properties can be avoided.

According to the permanent magnet of the present invention, in the step of calcining magnet powder, the magnet powder is held for predetermined length of time within a temperature range between 200 and 900 degrees Celsius. Therefore, thermal decomposition of the organometallic compound can be caused reliably and carbon contained in the magnet powder can be burned off more than required.

According to the permanent magnet of the present invention, the dehydrogenation process is performed in such manner that the magnet powder is held for predetermined length of time within a range between 200 and 600 degrees Celsius.

Therefore, even if $NdH_3$ having high activity level is produced in an Nd-based magnet that has undergone calcination process in hydrogen, all the produced $NdH_3$ can be changed to $NdH_2$ having low activity level.

According to the manufacturing method of a permanent magnet of the present invention, it is made possible to manufacture a permanent magnet configured such that traces of Dy or Tb contained in the organometallic compound that has been added to the magnet can be efficiently concentrated in grain boundaries of the magnet. Further, by performing dehydrogenation process after calcination, activity level is decreased with respect to the calcined body activated by the calcination process. Thereby, the resultant magnet particles are prevented from combining with oxygen and the decrease in the residual magnetic flux density and coercive force can also be prevented.

According to the manufacturing method of a permanent magnet of the present invention, the organometallic compound consisting of an alkyl group is used as organometallic compound to be added to magnet powder. Therefore, thermal decomposition of the organometallic compound can be caused easily when the magnet powder is calcined in hydrogen atmosphere. Consequently, carbon content in the calcined body can be reduced more reliably.

According to the manufacturing method of a permanent magnet of the present invention, the organometallic compound consisting of an alkyl group of which carbon number is any one of integer numbers 2 through 6 is used as organometallic compound to be added to magnet powder. Therefore, the organometallic compound can be thermally decomposed at low temperature when the magnet powder is calcined in hydrogen atmosphere. Consequently, thermal decomposition of the organometallic compound can be caused more easily in the entirety of the magnet powder. In other words, carbon content in the calcined body can be reduced more reliably through a calcination process.

According to the manufacturing method of a permanent magnet of the present invention, in the step of calcining the magnet powder, the magnet powder is held for predetermined length of time within a temperature range between 200 and 900 degrees Celsius. Therefore, thermal decomposition of the organometallic compound can be caused reliably and carbon contained therein can be burned off more than required.

According to the manufacturing method of a permanent magnet of the present invention, the dehydrogenation process is performed in such manner that the magnet powder is held for predetermined length of time within a range between 200 and 600 degrees Celsius. Therefore, even if $NdH_3$ having high activity level is produced in an Nd-based magnet that has undergone calcination process in hydrogen, all the produced $NdH_3$ can be changed to $NdH_2$ having low activity level.

BRIEF DESCRIPTION OF THE DRAWINGS

[FIG. 8] is a table illustrating residual carbon content in permanent magnets of embodiments 1 through 3 and comparative examples 1 through 3.

BEST MODE FOR CARRYING OUT THE INVENTION

Specific embodiments of a permanent magnet and a method for manufacturing the permanent magnet according to the present invention will be described below in detail with reference to the drawings.

[Constitution of Permanent Magnet]

Figure 1:
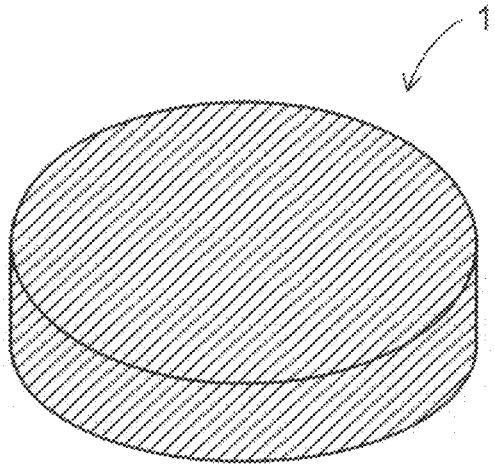
[FIG. 1] is an overall view of a permanent magnet directed to the invention.

First, a constitution of a permanent magnet 1 will be described. FIG. 1 is an overall view of the permanent magnet directed to the present invention. Incidentally, the permanent magnet 1 depicted in FIG. 1 is formed into a cylindrical shape. However, the shape of the permanent magnet 1 may be changed in accordance with the shape of a cavity used for compaction.

As the permanent magnet 1 according to the present invention, an Nd—Fe—B-based magnet may be used, for example. Further, Dy (dysprosium) or Tb (terbium) for increasing the coercive force of the permanent magnet 1 is concentrated on the boundary faces (grain boundaries) of Nd crystal grains forming the permanent magnet 1. Incidentally, the contents of respective components are regarded as Nd: 25 to 37 wt %, Dy (or Tb): 0.01 to 5 wt %, B: 1 to 2 wt %, and Fe (electrolytic iron): 60 to 75 wt %. Furthermore, the permanent magnet 1 may include other elements such as Co, Cu, Al or Si in small amount, in order to improve the magnetic properties thereof.

Figure 2:
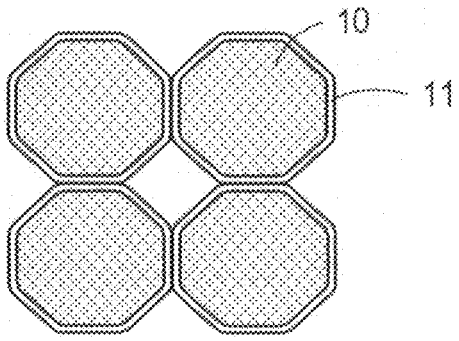
[FIG. 2] is an enlarged schematic view in vicinity of grain boundaries of the permanent magnet directed to the invention.

Specifically, in the permanent magnet 1 according to the present invention, Dy (or Tb) is concentrated onto the grain boundaries of the Nd crystal grains 10 by coating each surface of the Nd crystal grains 10 constituting the permanent magnet 1 with a Dy layer (or Tb layer) 11 as depicted in FIG. 2. FIG. 2 is an enlarged view showing the Nd crystal grains 10 constituting the permanent magnet 1.

The permanent magnet 1, as shown in FIG. 2, is constituted of the Nd crystal grains 10 and the Dy layers (or Tb layers) 11 coating the surfaces of Nd crystal grains 10. The Nd crystal grains 10 are, for instance, composed of an $Nd_2Fe_{14}B$ intermetallic compound, and the Dy layers 11 are, for instance, composed of a $(Dy_xNd_{1-x})_2Fe_{14}B$ intermetallic compound.

Figure 3:
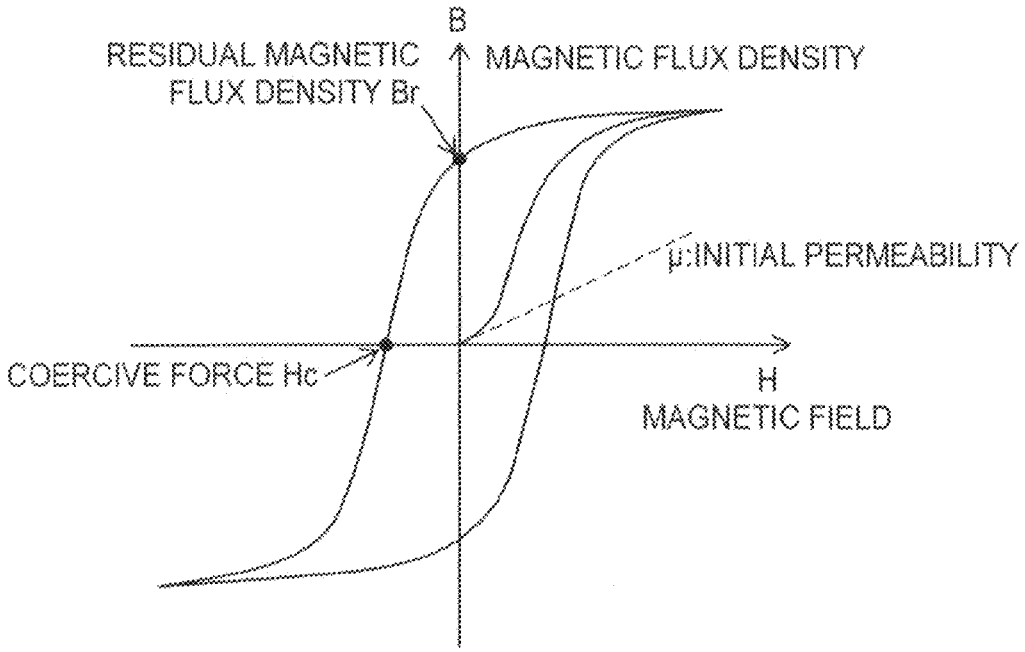
[FIG. 3] is a hysteresis curve of a ferromagnetic body.
Figure 4:
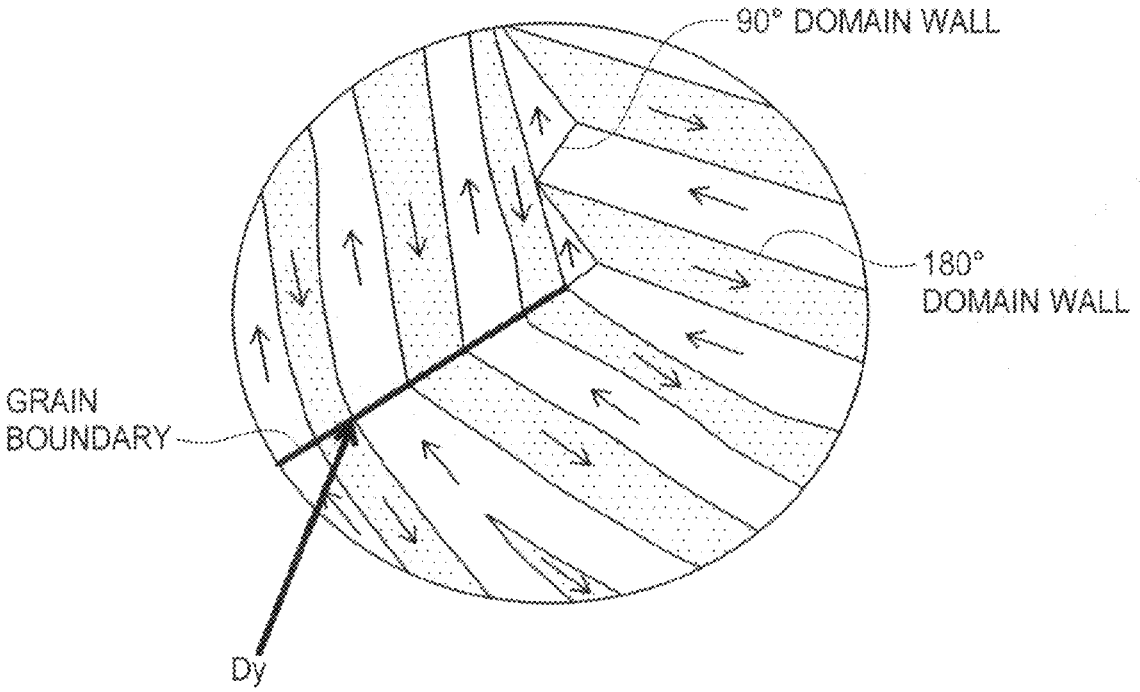
[FIG. 4] is a pattern diagram illustrating a magnetic domain structure of the ferromagnetic body.

A mechanism of improving the coercive force of the permanent magnet 1 with the Dy layers (or Tb layers) 11 will be described below referring to FIG. 3 and FIG. 4. FIG. 3 is a hysteresis curve of a ferromagnetic body, and FIG. 4 is a pattern diagram illustrating a magnetic domain structure of the ferromagnetic body.

As shown in FIG. 3, the coercive force of the permanent magnet is the intensity of a magnetic field needed for bringing the magnetic polarization into zero (that is to say, for magnetization reversal) when the magnetic field is applied from a magnetized state in the opposite direction. Accordingly, if the magnetization reversal can be inhibited, high coercive force can be obtained. Incidentally, magnetization processes of a magnetic body include rotational magnetization based on rotation of magnetic moment and domain wall displacement in which domain walls (consisting of a 90-degree domain wall and a 180-degree domain wall) as boundaries of magnetic domains move. In a sintered magnet such as the Nd—Fe—B-based magnet related to the present invention, reverse magnetic domain is most likely to occur in the vicinity of the surface of the crystal grain composing a main phase. Accordingly, in the present invention, through forming a phase where Dy or Tb substitutes for a part of Nd at the surface (outer shell) of a Nd crystal grain 10, the reverse magnetic domain is inhibited from generating. Here, Dy and Tb, with their high magnetic anisotropy, are both useful elements regarding the effect of improving the coercive force of the $Nd_2Fe_{14}B$ intermetallic compound (i.e., inhibiting magnetization reversal).

Here, in the present invention, the substitution of Dy or Tb is carried out before compaction of magnet powder through addition of an organometallic compound containing Dy (or Tb) milled as later described. Specifically, here, the organometallic compound containing the Dy (or Tb) is uniformly adhered to the particle surfaces of the Nd magnet particles by wet dispersion and the Dy (or Tb) included in the organometallic compound diffusively intrudes into the crystal growth region of the Nd magnet particles and substitutes for ND, to form the Dy layers (or Tb layers) 11 shown in FIG. 2, when the magnet powder to which the organometallic compound containing Dy (or Tb) is added is sintered. As a result, Dy (or Tb) is concentrated in a boundary face of the Nd crystal grains 10 as shown in FIG. 4, thereby enabling the coercive force of the permanent magnet 1 to be improved.

Furthermore, in the present invention, specifically as later described, the organometallic compound containing Dy (or Tb) is expressed by $M-(OR)_x$ (in the formula, M represents Dy or Tb, R represents a substituent group consisting of a straight-chain or branched-chain hydrocarbon and $_x$ represents an arbitrary integer), and the organometallic compound containing Dy (or Tb) (such as dysprosium ethoxide, dysprosium n-propoxide, terbium ethoxide) is added to an organic solvent and mixed with the magnet powder in a wet condition. Thus, the organometallic compound containing Dy (or Tb) is dispersed in the organic solvent, enabling the organometallic compound containing Dy (or Tb) to be adhered onto the particle surfaces of Nd magnet particles effectively.

Here, metal alkoxide is one of the organometallic compounds that satisfy the above structural formula $M-(OR)_x$ (in the formula, M represents Dy or Tb, R represents a substituent group consisting of a straight-chain or branched-chain hydrocarbon and $_x$ represents an arbitrary integer). The metal alkoxide is expressed by a general formula $M-(OR)_x$(M: metal element, R: organic group, n: valence of metal or metalloid). Furthermore, examples of metal or metalloid composing the metal alkoxide include W, Mo, V, Nb, Ta, Ti, Zr, Ir, Fe, Co, Ni, Cu, Zn, Cd, Al, Ga, In, Ge, Sb, Y, lanthanide and the like. However, in the present invention, Dy or Tb is specifically used.

Furthermore, the types of the alkoxide are not specifically limited, and there may be used, for instance, methoxide, ethoxide, propoxide, isopropoxide, butoxide or alkoxide carbon number of which is 4 or larger. However, in the present invention, those of low-molecule weight are used in order to reduce the carbon residue by means of thermal decomposition at a low temperature to be later described. Furthermore, methoxide carbon number of which is 1 is prone to decompose and difficult to deal with, therefore it is preferable to use alkoxide carbon number of which is 2 through 6 included in R, such as ethoxide, methoxide, isopropoxide, propoxide or butoxide. That is, in the present invention, it is preferable to use, as the organometallic compound to be added to the magnet powder, an organometallic compound expressed by $M-(OR)_x$ (in the formula, M represents Dy or Tb, R represents a straight-chain or branched-chain alkyl group and $_x$ represents an arbitrary integer) or it is more preferable to use an organometallic compound expressed by $M-(OR)_x$(in the formula, M represents Dy or Tb, R represents a straight-chain or branched-chain alkyl group of which carbon number is 2 through 6, and $_x$ represents an arbitrary integer).

Furthermore, a compact body compacted through powder compaction can be sintered under appropriate sintering conditions so that Dy or Tb can be prevented from being diffused or penetrated (solid-solutionized) into the Nd crystal grains 10. Thus, in the present invention, even if Dy or Tb is added, the area of substitution of the Dy or Tb can be limited within the outer shell portion. As a result, the phase of the $Nd_2Fe_{14}B$ intermetallic compound of the core accounts for the large proportion in volume, with respect to crystal grains as a whole (in other words, the sintered magnet in its entirety). Accordingly, the decrease of the residual magnetic flux density (magnetic flux density at the time when the intensity of the external magnetic field is brought to zero) can be inhibited.

Incidentally, the Dy layer (or Tb layer) 11 is not required to be a layer composed of only a Dy compound (or Tb compound), and may be a layer composed of a mixture of a Dy compound (or Tb compound) and a Nd compound. In such a case, a layer composed of the mixture of the Dy compound (or Tb compound) and the Nd compound are formed by adding the Nd compound. As a result, the liquid-phase sintering of the Nd magnet powder can be promoted at the time of sintering. The desirable Nd compound to be added may be $NdH_2$, neodymium acetate hydrate, neodymium(III) acetylacetonate trihydrate, neodymium(III) 2-ethylhexanoate, neodymium (III) hexafluoroacetylacetonate dihydrate, neodymium isopropoxide, neodymium(III) phosphate n-hydrate, neodymium trifluoroacetylacetonate, and neodymium trifluoromethanesulfonate or the like.

However, as a configuration for concentrating Dy or Tb on the grain boundaries of the Nd crystal grains 10, there may be employed a configuration in which agglomerates composed of Dy or Tb are scattered onto the grain boundaries of the Nd crystal grains 10. The similar effect can be obtained even in such a configuration. The concentration of Dy or Tb in the grain boundaries of the Nd crystal grains 10 can be confirmed, for instance, through SEM, TEM or three-dimensional atom probe technique.

[First Method for Manufacturing Permanent Magnet]

Figure 5:
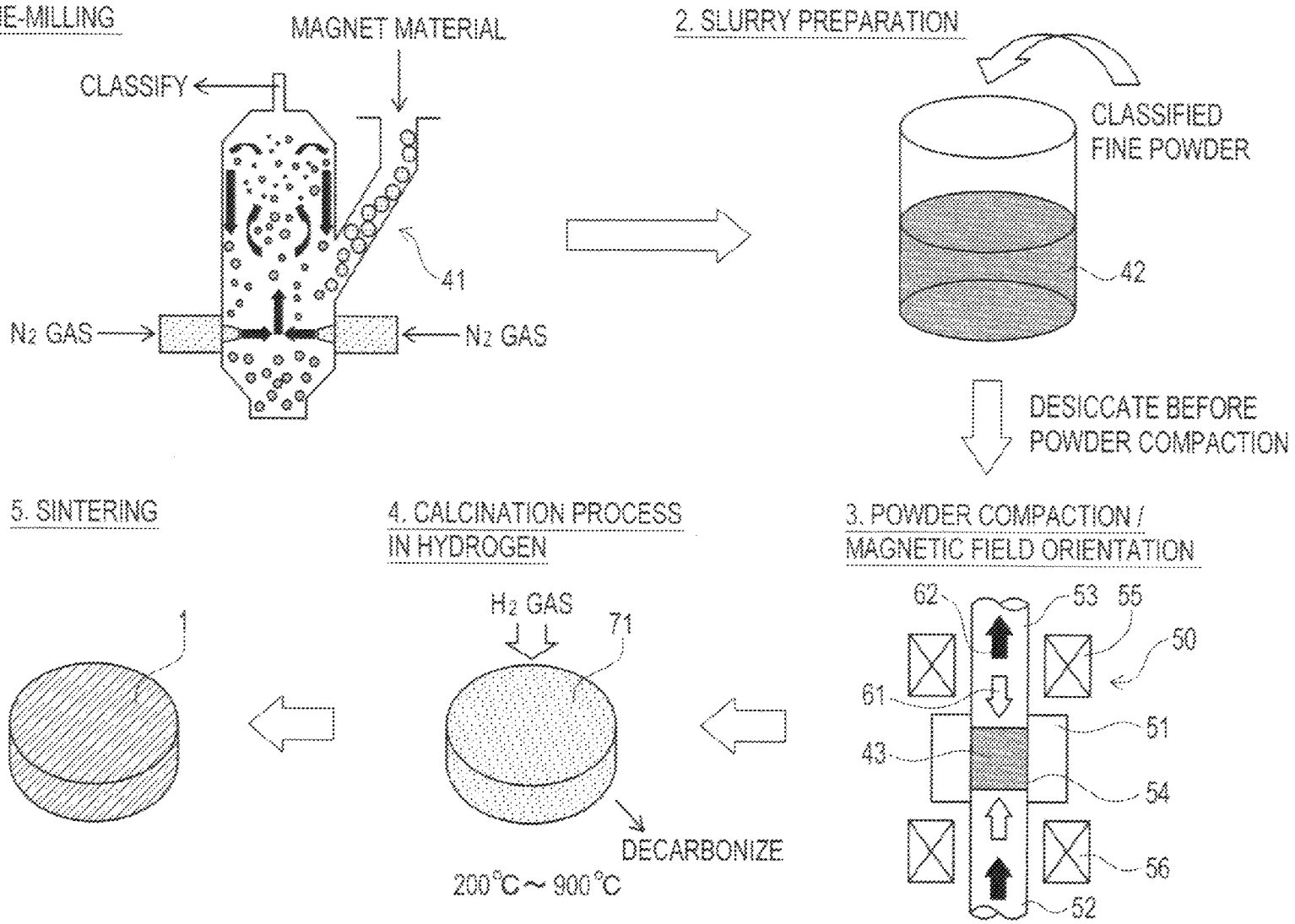
[FIG. 5] is an explanatory diagram illustrating manufacturing processes of a permanent magnet according to a first manufacturing method of the invention.

Next, the first method for manufacturing the permanent magnet 1 directed to the present invention will be described below with reference to FIG. 5. FIG. 5 is an explanatory view illustrating a manufacturing process in the first method for manufacturing the permanent magnet 1 directed to the present invention.

First, there is manufactured an ingot comprising Nd—Fe—B of certain fraction (for instance, Nd: 32.7 wt %, Fe (electrolytic iron): 65.96 wt %, and B: 1.34 wt %). Thereafter the ingot is coarsely milled using a stamp mill, a crusher, etc. to a size of approximately 200 μm. Otherwise, the ingot is dissolved, formed into flakes using a strip-casting method, and then coarsely powdered using a hydrogen pulverization method.

Next, the coarsely milled magnet powder is finely milled with a jet mill 41 to form fine powder of which the average particle diameter is smaller than a predetermined size (for instance, 0.1 μm through 5.0 μm) in: (a) an atmosphere composed of inert gas such as nitrogen gas, argon (Ar) gas, helium (He) gas or the like having an oxygen content of substantially 0%; or (b) an atmosphere composed of inert gas such as nitrogen gas, Ar gas, He gas or the like having an oxygen content of 0.0001 through 0.5%. Here, the term "having an oxygen content of substantially 0%" is not limited to a case where the oxygen content is completely 0%, but may include a case where oxygen is contained in such an amount as to allow a slight formation of an oxide film on the surface of the fine powder.

In the meantime, organometallic compound solution is prepared for adding to the fine powder finely milled by the jet mill 41. Here, an organometallic compound containing Dy (or Tb) is added in advance to the organometallic compound solution and dissolved therein. Incidentally, in the present invention, it is preferable to use, as the organometallic compound to be dissolved, an organometallic compound (such as dysprosium ethoxide, dysprosium n-propoxide or terbium ethoxide) pertinent to formula $M-(OR)_x$ (in the formula, M represents Dy or Tb, R represents a straight-chain or branched-chain alkyl group of which carbon number is 2 through 6 and $_x$ represents an arbitrary integer). Furthermore, the amount of the organometallic compound containing Dy (or Tb) to be dissolved is not particularly limited, however, it is preferably adjusted to such an amount that the Dy (or Tb) content with respect to the sintered magnet is 0.001 wt % through 10 wt %, or more preferably, 0.01 wt % through 5 wt %, as above described.

Successively, the above organometallic compound solution is added to the fine powder classified with the jet mill 41. Through this, slurry 42 in which the fine powder of magnet raw material and the organometallic compound solution are mixed is prepared. Here, the addition of the organometallic compound solution is performed in an atmosphere composed of inert gas such as nitrogen gas, Ar gas or He gas.

Thereafter, the prepared slurry 42 is desiccated in advance through vacuum desiccation or the like before compaction and desiccated magnet powder 43 is obtained. Then, the desiccated magnet powder is subjected to powder-compaction to form a given shape using a compaction device 50. There are dry and wet methods for the powder compaction, and the dry method includes filling a cavity with the desiccated fine powder and the wet method includes preparing slurry of the desiccated fine powder using solvent and then filling a cavity therewith. In this embodiment, a case where the dry method is used is described as an example. Furthermore, the organometallic compound solution can be volatilized at the sintering stage after compaction.

As illustrated in FIG. 5, the compaction device 50 has a cylindrical mold 51, a lower punch 52 and an upper punch 53, and a space surrounded therewith forms a cavity 54. The lower punch 52 slides upward/downward with respect to the mold 51, and the upper punch 53 slides upward/downward with respect to the mold 51, in a similar manner.

In the compaction device 50, a pair of magnetic field generating coils 55 and 56 is disposed in the upper and lower positions of the cavity 54 so as to apply magnetic flux to the magnet powder 43 filling the cavity 54. The magnetic field to be applied may be, for instance, 1 MA/m.

When performing the powder compaction, firstly, the cavity 54 is filled with the desiccated magnet powder 43. Thereafter, the lower punch 52 and the upper punch 53 are activated to apply pressure against the magnet powder 43 filling the cavity 54 in a pressurizing direction of arrow 61, thereby performing compaction thereof. Furthermore, simultaneously with the pressurization, pulsed magnetic field is applied to the magnet powder 43 filling the cavity 54, using the magnetic field generating coils 55 and 56, in a direction of arrow 62 which is parallel with the pressuring direction. As a result, the magnetic field is oriented in a desired direction. Incidentally, it is necessary to determine the direction in which the magnetic field is oriented while taking into consideration the magnetic field orientation required for the permanent magnet 1 formed from the magnet powder 43.

Furthermore, in a case where the wet method is used, slurry may be injected while applying the magnetic field to the cavity 54, and in the course of the injection or after termination of the injection, a magnetic field stronger than the initial magnetic field may be applied to perform the wet molding. Furthermore, the magnetic field generating coils 55 and 56 may be disposed so that the application direction of the magnetic field is perpendicular to the pressuring direction.

Secondly, the compact body 71 formed through the powder compaction is held for several hours (for instance, five hours) in hydrogen atmosphere at 200 through 900 degrees Celsius, or more preferably 400 through 900 degrees Celsius (for instance, 600 degrees Celsius), to perform a calcination process in hydrogen. The hydrogen feed rate during the calcination is 5 L/min. So-called decarbonization is performed during this calcination process in hydrogen. In the decarbonization, the organometallic compound is thermally decomposed so that carbon content in the calcined body can be decreased. Furthermore, calcination process in hydrogen is to be performed under a condition of less than 0.2 wt % carbon content in the calcined body, or more preferably less than 0.1 wt %. Accordingly, it becomes possible to densely sinter the permanent magnet 1 as a whole in the following sintering process, and the decrease in the residual magnetic flux density and coercive force can be prevented.

Here, $NdH_3$ exists in the compact body 71 calcined through the calcination process in hydrogen as above described, which indicates a problematic tendency to combine with oxygen. However, in the first manufacturing method, the compact body 71 after the calcination is brought to the later-described sintering without being exposed to the external air, eliminating the need for the dehydrogenation process. The hydrogen contained in the compact body is removed while being sintered.

Following the above, there is performed a sintering process for sintering the compact body 71 calcined through the calcination process in hydrogen. However, for a sintering method for the compact body 71, there can be employed, besides commonly-used vacuum sintering, pressure sintering in which the compact body 71 is sintered in a pressured state. For instance, when the sintering is performed in the vacuum sintering, the temperature is risen to approximately 800 through 1080 degrees Celsius in a given rate of temperature increase and held for approximately two hours. During this period, the vacuum sintering is performed, and the degree of vacuum is preferably equal to or smaller than $10^{-4}$ Torr. The compact body 71 is then cooled down, and again undergoes a heat treatment in 600 through 1000 degrees Celsius for two hours. As a result of the sintering, the permanent magnet 1 is manufactured.

Meanwhile, the pressure sintering includes, for instance, hot pressing, hot isostatic pressing (HIP), high pressure synthesis, gas pressure sintering, and spark plasma sintering (SPS) and the like. However, it is preferable to adopt the spark plasma sintering which is uniaxial pressure sintering in which pressure is uniaxially applied and also in which sintering is performed by electric current sintering, so as to prevent grain growth of the magnet particles during the sintering and also to prevent warpage formed in the sintered magnets. Incidentally, the following are the preferable conditions when the sintering is performed in the SPS; pressure is applied at 30 MPa, the temperature is risen in a rate of 10 degrees Celsius per minute until reaching 940 degrees Celsius in vacuum atmosphere of several Pa or lower and then the state of 940 degrees Celsius in vacuum atmosphere is held for approximately five minutes. The compact body 71 is then cooled down, and again undergoes a heat treatment in 600 through 1000 degrees Celsius for two hours. As a result of the sintering, the permanent magnet 1 is manufactured.

[Second Method for Manufacturing Permanent Magnet]

Figure 6:
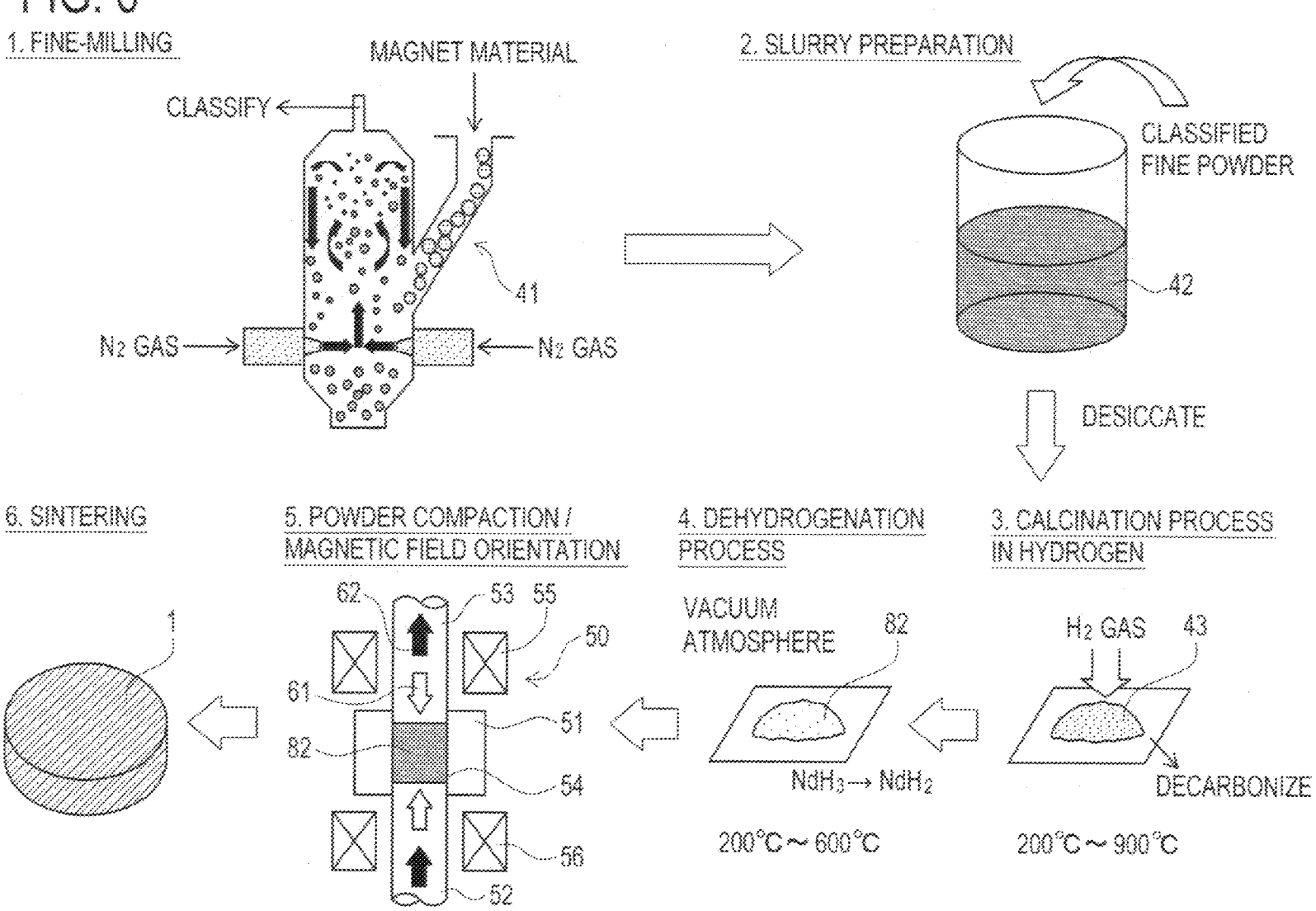
[FIG. 6] is an explanatory diagram illustrating manufacturing processes of a permanent magnet according to a second manufacturing method of the invention.

Next, the second method for manufacturing the permanent magnet 1 which is an alternative manufacturing method will be described below with reference to FIG. 6. FIG. 6 is an explanatory view illustrating a manufacturing process in the second method for manufacturing the permanent magnet 1 directed to the present invention.

The process until the slurry 42 is manufactured is the same as the manufacturing process in the first manufacturing method already discussed referring to FIG. 5, therefore detailed explanation thereof is omitted.

Firstly, the prepared slurry 42 is desiccated in advance through vacuum desiccation or the like before compaction and desiccated magnet powder 43 is obtained. Then, the desiccated magnet powder 43 is held for several hours (for instance, five hours) in hydrogen atmosphere at 200 through 900 degrees Celsius, or more preferably 400 through 900 degrees Celsius (for instance, 600 degrees Celsius), for a calcination process in hydrogen. The hydrogen feed rate during the calcination is 5 L/min. So-called decarbonization is performed in this calcination process in hydrogen. In the decarbonization, the organometallic compound is thermally decomposed so that carbon content in the calcined body can be decreased. Furthermore, calcination process in hydrogen is to be performed under a condition of less than 0.2 wt % carbon content in the calcined body, or more preferably less than 0.1 wt %. Accordingly, it becomes possible to densely sinter the permanent magnet 1 as a whole in the following sintering process, and the decrease in the residual magnetic flux density and coercive force can be prevented.

Secondly, the powdery calcined body 82 calcined through the calcination process in hydrogen is held for one through three hours in vacuum atmosphere at 200 through 600 degrees Celsius, or more preferably 400 through 600 degrees Celsius for a dehydrogenation process. Incidentally, the degree of vacuum is preferably equal to or smaller than 0.1 Torr.

Here, $NdH_3$ exists in the calcined body 82 calcined through the calcination process in hydrogen as above described, which indicates a problematic tendency to combine with oxygen.

Figure 7:
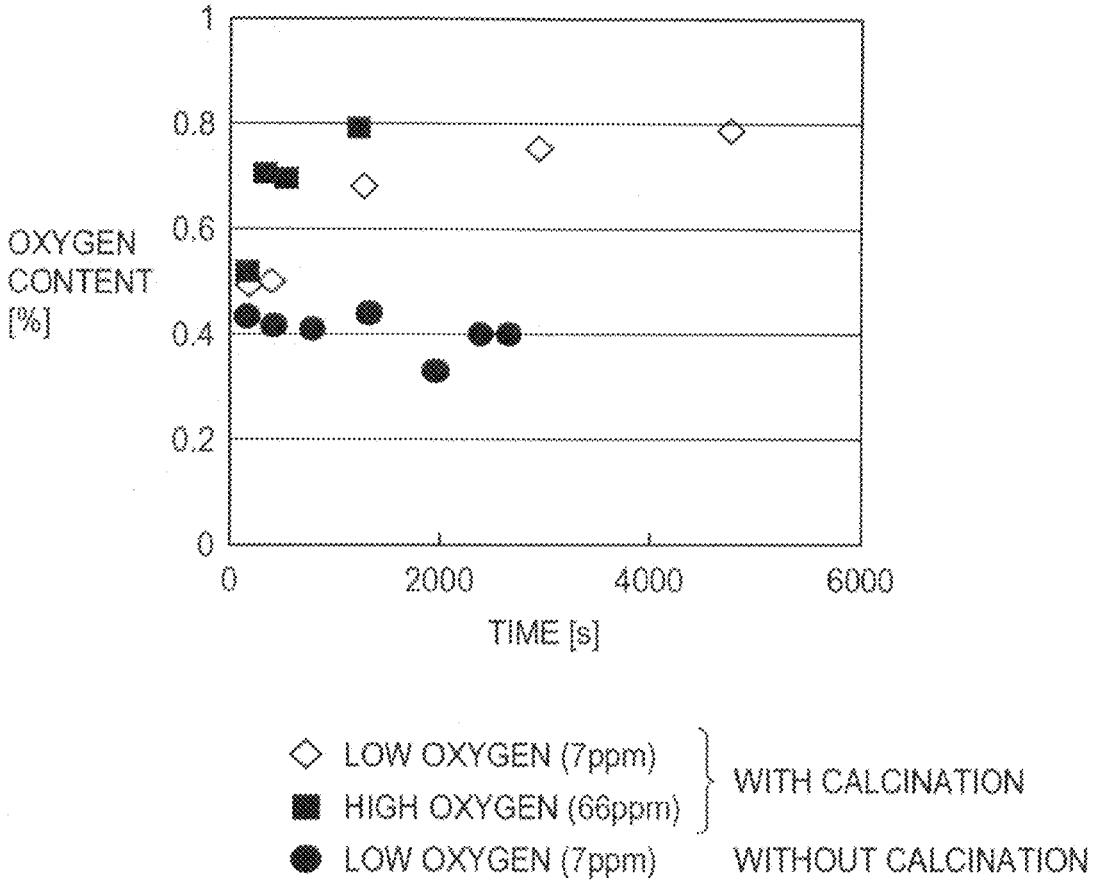
[FIG. 7] is a diagram illustrating changes of oxygen content with and without a calcination process in hydrogen.

FIG. 7 is a diagram depicting oxygen content of magnet powder with respect to exposure duration, when Nd magnet powder with a calcination process in hydrogen and Nd magnet powder without a calcination process in hydrogen are exposed to each of the atmosphere with oxygen concentration of 7 ppm and the atmosphere with oxygen concentration of 66 ppm. As illustrated in FIG. 7, when the Nd magnet powder with the calcination process in hydrogen is exposed to the atmosphere with high-oxygen concentration of 66 ppm, the oxygen content of the magnet powder increases from 0.4% to 0.8% in approximately 1000 sec. Even when the Nd magnet powder with the calcination process is exposed to the atmosphere with low-oxygen concentration of 7 ppm, the oxygen content of the magnet powder still increases from 0.4% to the similar amount 0.8%, in approximately 5000 sec. Oxygen combined with Nd causes the decrease in the residual magnetic flux density and in the coercive force.

Therefore, in the above dehydrogenation process, $NdH_3$ (having high activity level) in the calcined body 82 created at the calcination process in hydrogen is gradually changed: from $NdH_3$ (having high activity level) to $NdH_2$ (having low activity level). As a result, the activity level is decreased with respect to the calcined body 82 activated by the calcination process in hydrogen. Accordingly, if the calcined body 82 calcined at the calcination process in hydrogen is later moved into the external air, Nd therein is prevented from combining with oxygen, and the decrease in the residual magnetic flux density and coercive force can also be prevented.

Then, the powdery calcined body 82 after the dehydrogenation process undergoes the powder compaction to be compressed into a given shape using the compaction device 50. Details are omitted with respect to the compaction device 50 because the manufacturing process here is similar to that of the first manufacturing method already described referring to FIG. 5.

Then, there is performed a sintering process for sintering the compacted-state calcined body 82. The sintering process is performed by the vacuum sintering or the pressure sintering similar to the above first manufacturing method. Details of the sintering condition are omitted because the manufacturing process here is similar to that of the first manufacturing method already described. As a result of the sintering, the permanent magnet 1 is manufactured.

However, the second manufacturing method discussed above has an advantage that the calcination process in hydrogen is performed to the powdery magnet particles, therefore the thermal decomposition of the organometallic compound can be more easily caused to the whole magnet particles, in comparison with the first manufacturing method in which the calcination process in hydrogen is performed to the compacted magnet particles. That is, it becomes possible to securely decrease the carbon content of the calcined body, in comparison with the first manufacturing method.

However, in the first manufacturing method, the compact body 71 after calcined in hydrogen is brought to the sintering without being exposed to the external air, eliminating the need for the dehydrogenation process. Accordingly, the manufacturing process can be simplified in comparison with the second manufacturing method. However, also in the second manufacturing method, in a case where the sintering is performed without any exposure to the external air after calcined in hydrogen, the dehydrogenation process becomes unnecessary.

Embodiments

Here will be described embodiments according to the present invention referring to comparative examples for comparison.

(Embodiment 1)

In comparison with fraction regarding alloy composition of a neodymium magnet according to the stoichiometric composition (Nd: 26.7 wt %, Fe (electrolytic iron): 72.3 wt %, B: 1.0 wt %), proportion of Nd in that of the neodymium magnet powder for the embodiment 1 is set higher, such as Nd/Fe/B=32.7/65.96/1.34 in wt %, for instance. Further, 5 wt % of dysprosium n-propoxide has been added as organometallic compound containing Dy (or Tb) to milled neodymium magnet powder. A calcination process has been performed by holding the magnet powder before compaction for five hours in hydrogen atmosphere at 600 degrees Celsius. The hydrogen feed rate during the calcination is 5 L/min. Sintering of the compacted-state calcined body has been performed in the SPS. Other processes are the same as the processes in [Second Method for Manufacturing Permanent Magnet] mentioned above.

(Embodiment 2)

Terbium ethoxide has been used as organometallic compound to be added. Other conditions are the same as the conditions in embodiment 1.

(Embodiment 3)

Dysprosium ethoxide has been used as organometallic compound to be added. Other conditions are the same as the conditions in embodiment 1.

(Embodiment 4)

Sintering of a compacted-state calcined body has been performed in the vacuum sintering instead of the SPS. Other conditions are the same as the conditions in embodiment 1.

COMPARATIVE EXAMPLE 1

Dysprosium n-propoxide has been used as organometallic compound to be added, and sintering has been performed without undergoing a calcination process in hydrogen. Other conditions are the same as the conditions in embodiment 1.

COMPARATIVE EXAMPLE 2

Terbium ethoxide has been used as organometallic compound to be added, and sintering has been performed without undergoing a calcination process in hydrogen. Other conditions are the same as the conditions in embodiment 1.

COMPARATIVE EXAMPLE 3

Dysprosium acetylacetonate has been used as organometallic compound to be added. Other conditions are the same as the conditions in embodiment 1.

COMPARATIVE EXAMPLE 4

A calcination process has been performed in helium atmosphere instead of hydrogen atmosphere. Further, sintering of a compacted-state calcined body has been performed in the vacuum sintering instead of the SPS. Other conditions are the same as the conditions in embodiment 1.

COMPARATIVE EXAMPLE 5

A calcination process has been performed in vacuum atmosphere instead of hydrogen atmosphere. Further, sintering of a compacted-state calcined body has been performed in the vacuum sintering instead of the SPS. Other conditions are the same as the conditions in embodiment 1.

(Comparison of Embodiments with Comparative) Examples Regarding Residual Carbon Content The table of FIG. 8 shows residual carbon content [wt %] in each permanent magnet according to embodiments 1 through 3 and comparative examples 1 through 3.

As shown in FIG. 8, the carbon content remaining in the magnet particles can be significantly reduced in embodiments 1 through 3 in comparison with comparative examples 1 through 3. Specifically, the carbon content remaining in the magnet particles can be made less than 0.2 wt % in each of embodiments 1 through 3.

Further, in comparison between the embodiments 1, 3 and the comparative examples 1, 2, respectively, despite addition of the same organometallic compound, they have got significant difference with respect to carbon content in magnet particles depending on with or without calcination process in hydrogen; the cases with the calcination process in hydrogen can reduce carbon content more significantly than the cases without. In other words, through the calcination process in hydrogen, there can be performed a so-called decarbonization in which the organometallic compound is thermally decomposed so that carbon content in the calcined body can be decreased. As a result, it becomes possible to densely sinter the entirety of the magnet and to prevent the coercive force from degradation.

In comparison between the embodiments 1 through 3 and comparative example 3, carbon content in the magnet powder can be more significantly decreased in the case of adding an organometallic compound represented as M–(OR) x (in the formula, M represents Dy or Tb, R represents a substituent group consisting of a straight-chain or branched-chain hydrocarbon and x represents an arbitrary integer), than the case of adding other organometallic compound. In other words, decarbonization can be easily caused during the calcination process in hydrogen by using an organometallic compound represented as M–(OR)x (in the formula, M represents Dy or Tb, R represents a substituent group consisting of a straight-chain or branched-chain hydrocarbon and x represents an arbitrary integer) as additive. As a result, it becomes possible to densely sinter the entirety of the magnet and to prevent the coercive force from degradation. Further, it is preferable to use as organometallic compound to be added an organometallic compound consisting of an alkyl group, more preferably organometallic compound consisting of an alkyl group of which carbon number is any one of integer numbers 2 through 6, which enables the organometallic compound to thermally decompose at a low temperature when calcining the magnet powder in hydrogen atmosphere. Thereby, thermal decomposition of the organometallic compound can be more easily performed over the entirety of the magnet particles.

(Result of Surface Analysis with XMA Carried Out for Permanent Magnets)

Figure 9:
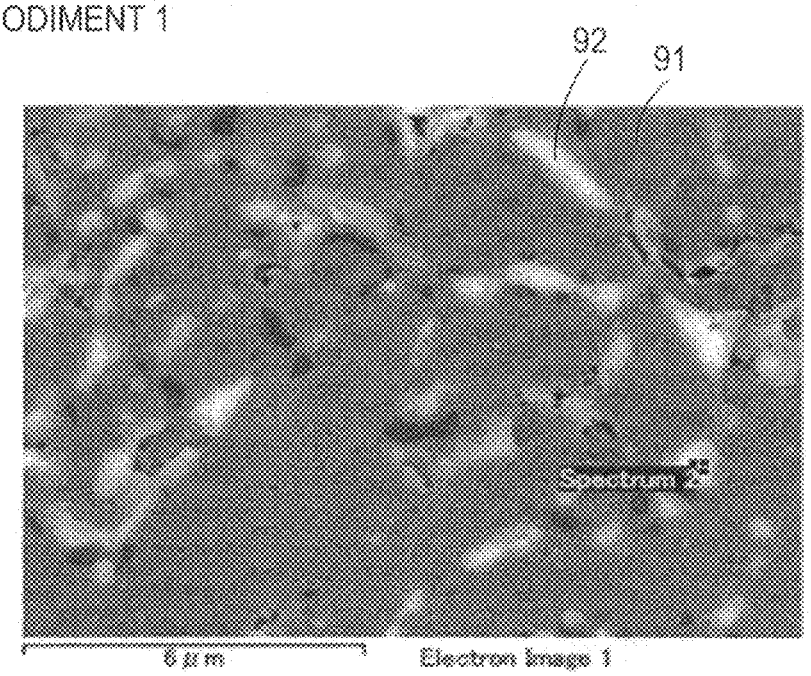
[FIG. 9] is an SEM image and an element analysis result on a grain boundary phase of the permanent magnet of the embodiment 1 after sintering.
Figure 9:
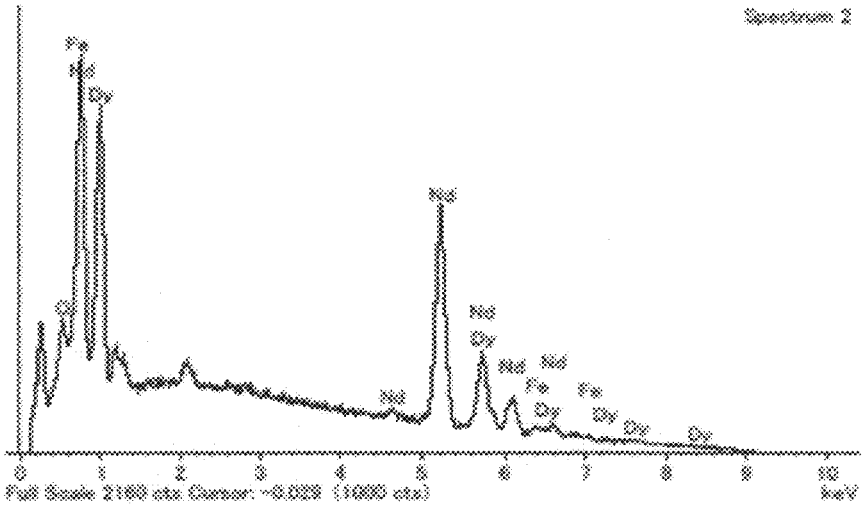
Figure 10:
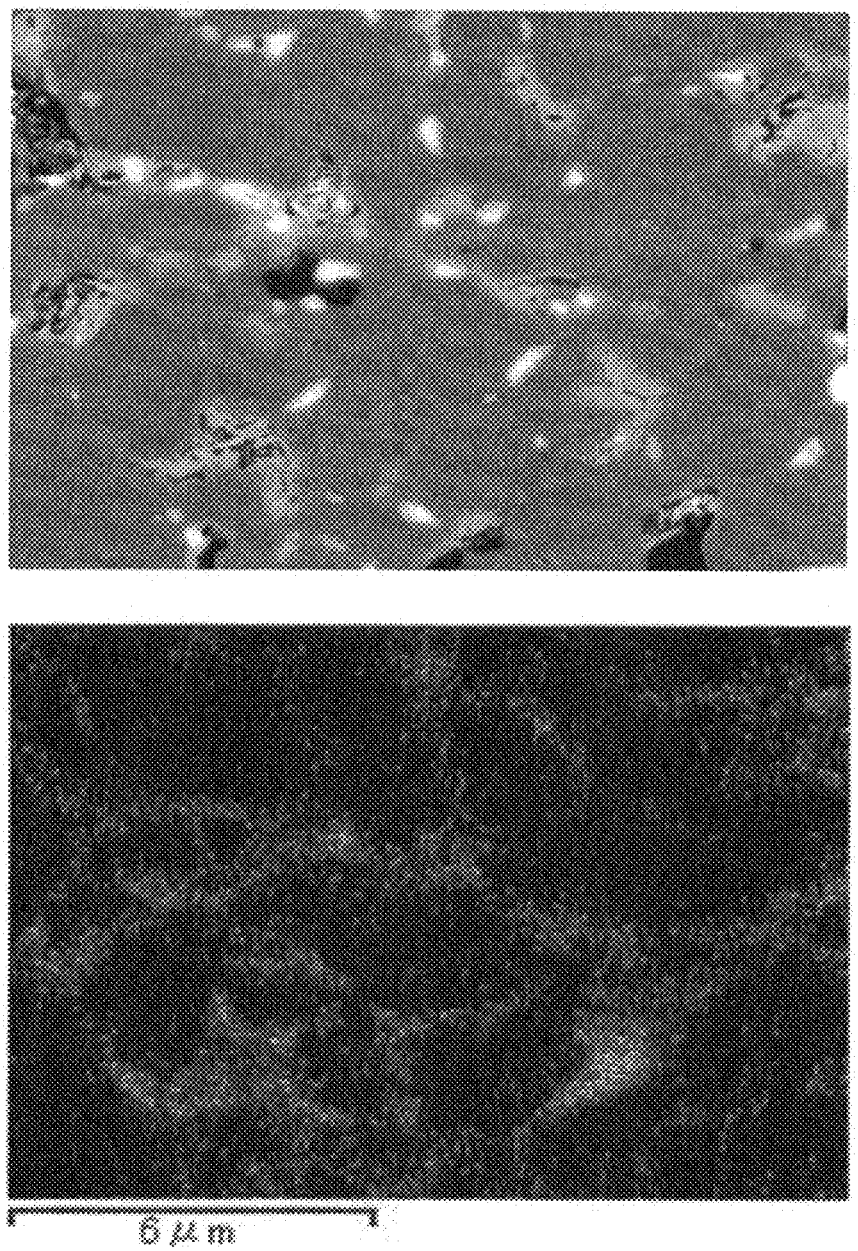
[FIG. 10] is an SEM image and mapping of a distribution state of Dy element in the same visual field with the SEM image of the permanent magnet of the embodiment 1 after sintering.
Figure 11:
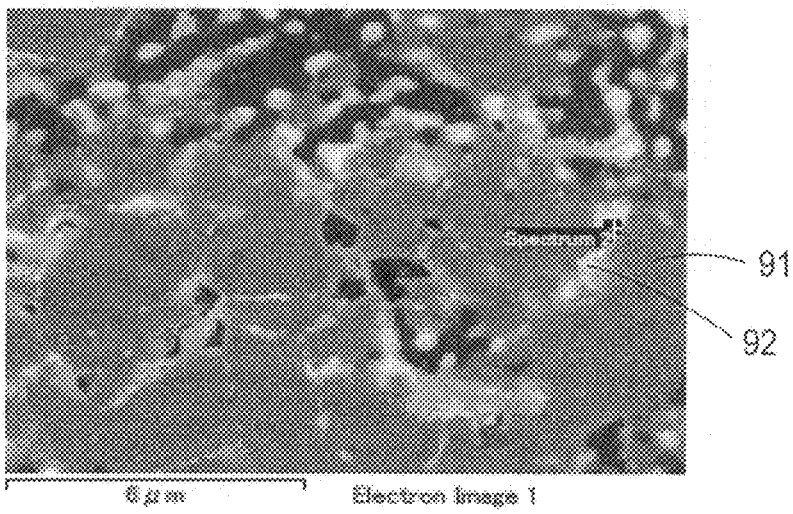
[FIG. 11] is an SEM image and an element analysis result on a grain boundary phase of the permanent magnet of the embodiment 2 after sintering.
Figure 11:
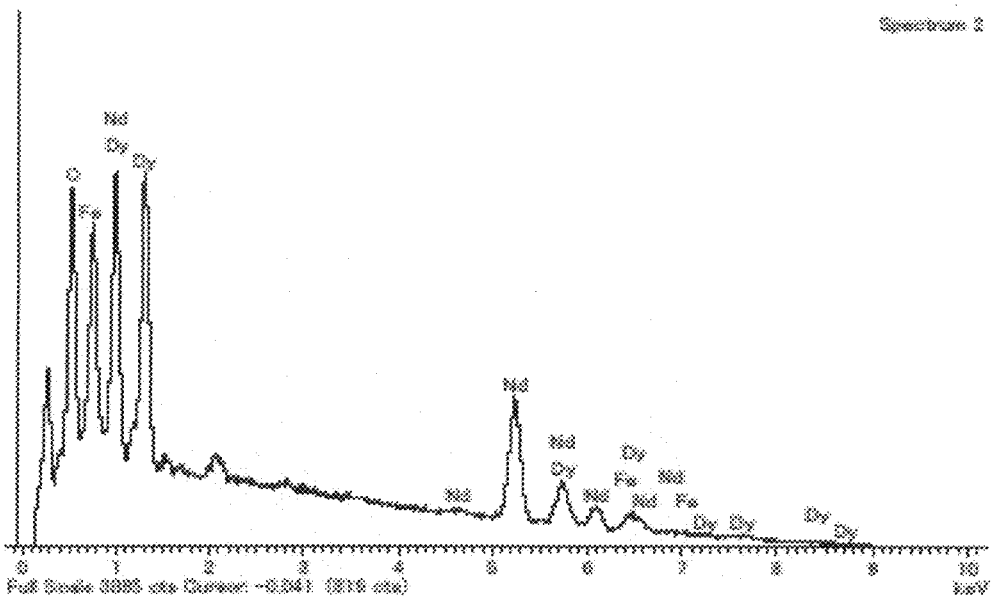
Figure 12:
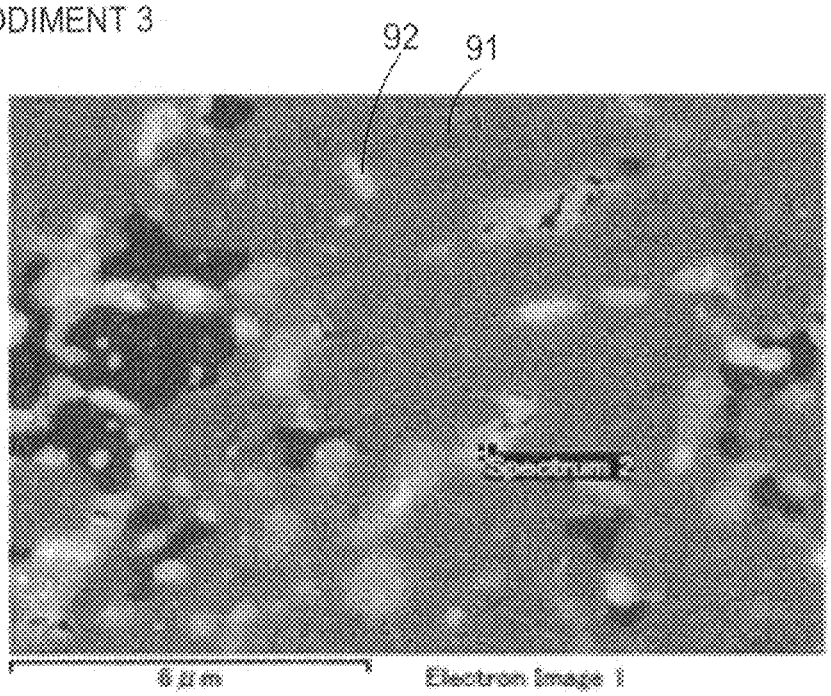
[FIG. 12] is an SEM image and an element analysis result on a grain boundary phase of the permanent magnet of the embodiment 3 after sintering.
Figure 12:
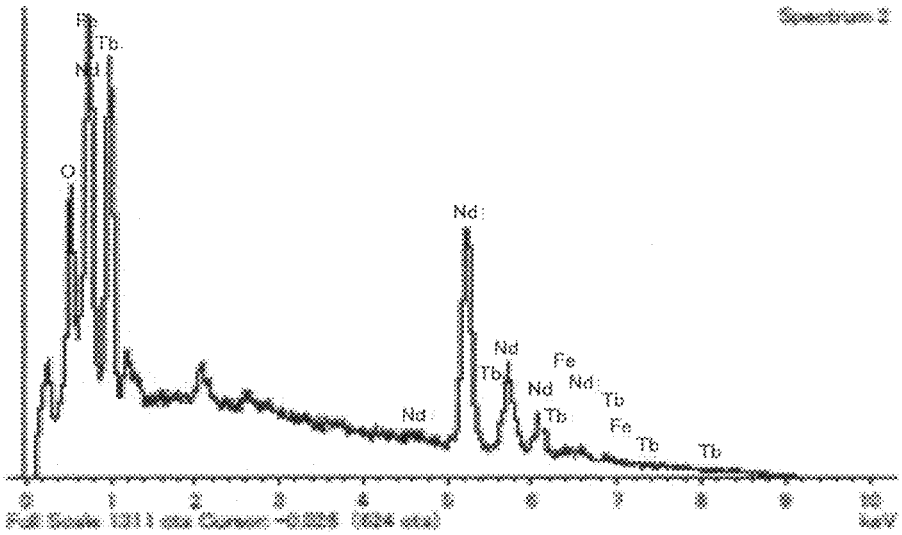
Figure 13:
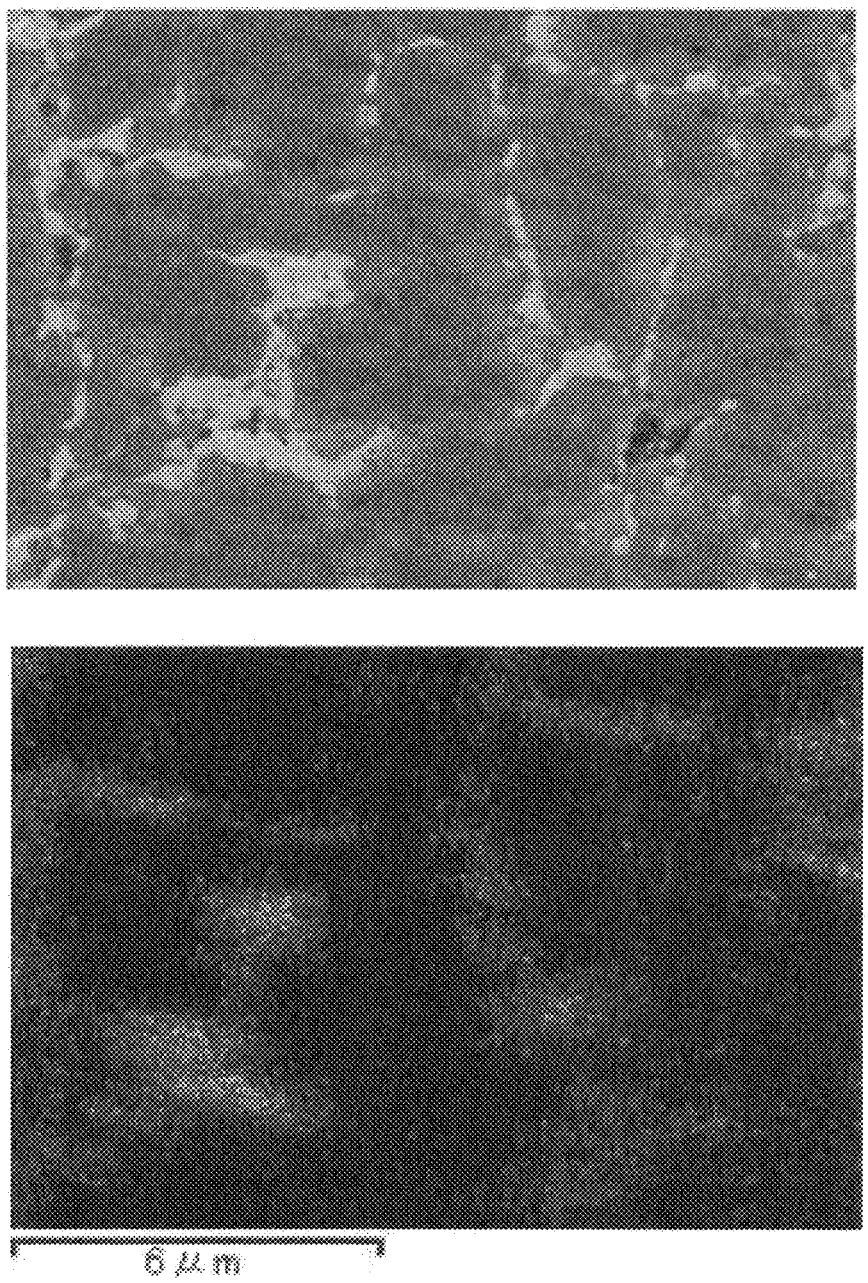
[FIG. 13] is an SEM image and mapping of a distribution state of Tb element in the same visual field with the SEM image of the permanent magnet of the embodiment 3 after sintering.

Surface analysis with an XMA (X-ray micro analyzer) has been carried out for each of permanent magnets directed to the embodiments 1 through 3. FIG. 9 is an SEM image and an element analysis result on a grain boundary phase of the permanent magnet of the embodiment 1 after sintering. FIG. 10 is an SEM image and mapping of a distribution state of Dy element in the same visual field with the SEM image of the permanent magnet of the embodiment 1 after sintering. FIG. 11 is an SEM image and an element analysis result on a grain boundary phase of the permanent magnet of the embodiment 2 after sintering. FIG. 12 is an SEM image and an element analysis result on a grain boundary phase of the permanent magnet directed to the embodiment 3 after sintering. FIG. 13 is an SEM image and mapping of a distribution state of Tb element in the same visual field with the SEM image of the permanent magnet of the embodiment 3 after sintering.

As shown in FIG. 9, FIG. 11 and FIG. 12, Dy as oxide or non-oxide is detected in the grain boundary phase of each of the permanent magnets of the embodiments 1, 2 and 3. That is, in each of the permanent magnets directed to the embodiments 1, 2 and 3, it is observed that Dy disperses from a grain boundary phase to a main phase and a phase where Dy substitutes for a part of Nd is formed on surfaces of main phase particles (grain boundary) at outer surface portions of the main phase (outer shell).

In the mapping of FIG. 10, white portions represent distribution of Dy element. The set of the SEM image and the mapping in FIG. 10 explains that white portions (i.e., Dy element) are concentrated at the perimeter of a main phase. That is, in the permanent magnet of the embodiment 1, Dy is concentrated at the grain boundaries thereof. On the other hand, in the mapping of FIG. 13, white portions represent distribution of Tb element. The set of the SEM image and the mapping in FIG. 13 explains that white portions (i.e., Tb element) are concentrated at the perimeter of a main phase. That is, in the permanent magnet of the embodiment 3, Tb is concentrated at the grain boundaries thereof.

The above results indicate that, in the embodiments 1 through 3, Dy or Tb can be concentrated in grain boundaries of the magnet.

(Comparative Review with SEM Images of Embodiments and Comparative Examples)

Figure 14:
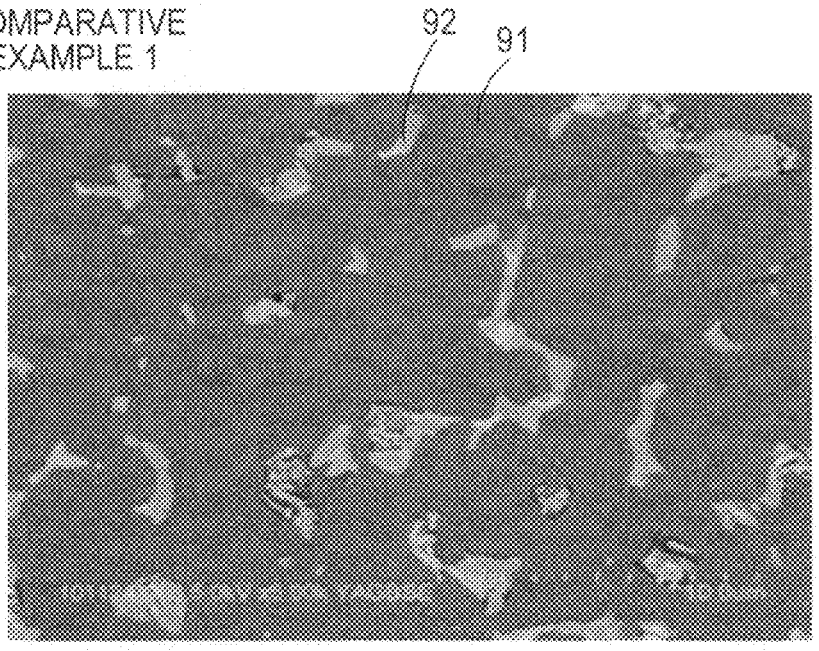
[FIG. 14] is an SEM image of the permanent magnet of the comparative example 1 after sintering.
Figure 15:
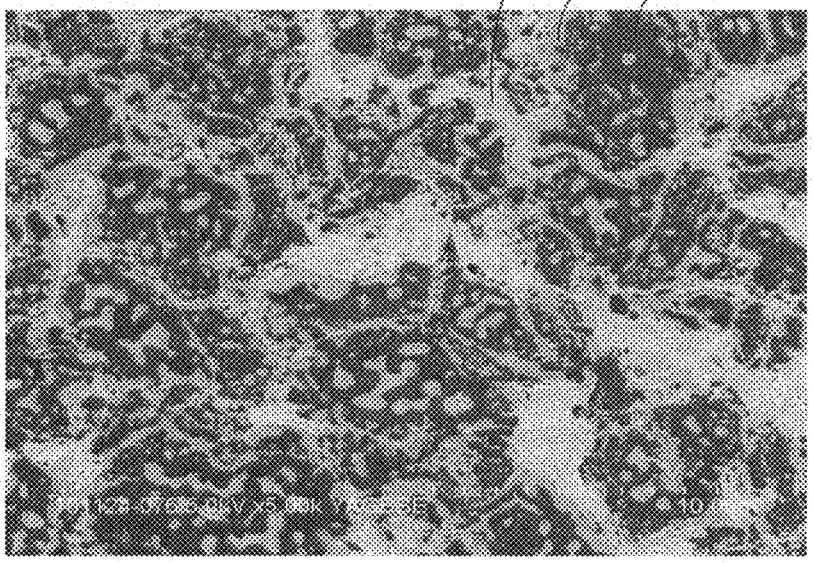
[FIG. 15] is an SEM image of the permanent magnet of the comparative example 2 after sintering.
Figure 16:
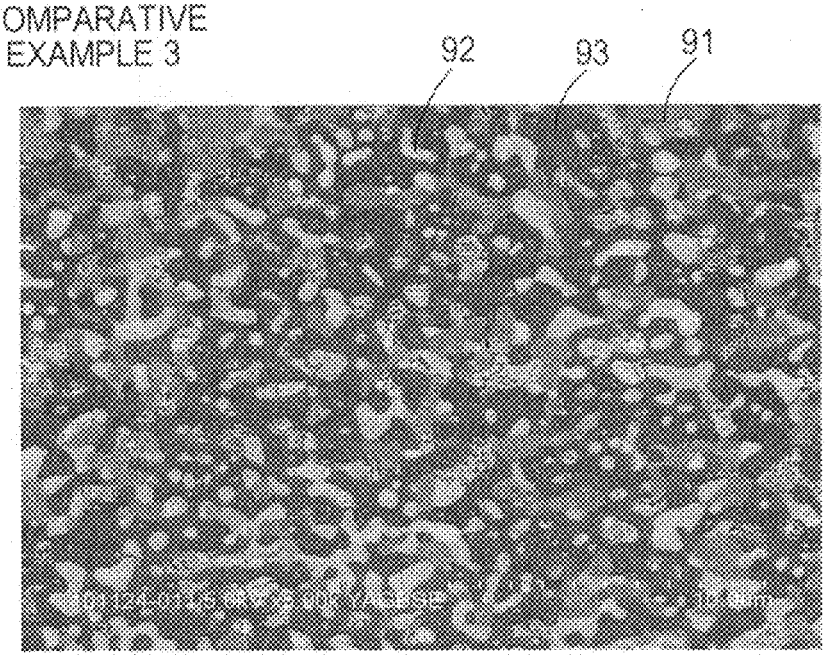
[FIG. 16] is an SEM image of the permanent magnet of the comparative example 3 after sintering.

FIG. 14 is an SEM image of the permanent magnet of the comparative example 1 after sintering. FIG. 15 is an SEM image of the permanent magnet of the comparative example 2 after sintering. FIG. 16 is an SEM image of the permanent magnet of the comparative example 3 after sintering.

Comparison will be made with the SEM images of the embodiments 1 through 3 and those of comparative examples 1 through 3. With respect to the embodiments 1 through 3 and the comparative example 1 in which residual carbon content is equal to specific amount or lower (e.g., 0.2 wt % or lower), there can be commonly observed formation of a sintered permanent magnet basically constituted by a main phase of neodymium magnet ($Nd_2Fe_{14}B$) 91 and a grain boundary phase 92 that looks like white speckles. Also, a small amount of alpha iron phase is formed there. On the other hand, with respect to the comparative examples 2 and 3 in which residual carbon content is larger in comparison with the embodiments 1 through 3 and the comparative example 1, there can be commonly observed formation of considerable number of alpha iron phases 93 that look like black belts in addition to a main phase 91 and a grain boundary phase 92. It is to be noted that alpha iron is generated due to carbide that remains at the time of sintering. That is, reactivity of Nd and carbon is significantly high and in case carbon-containing material remains in the organometallic compound even at a high-temperature stage in a sintering process like the comparative examples 2 and 3, carbide is formed. Consequently, the thus formed carbide causes alpha iron to separate out in a main phase of a sintered magnet and magnetic properties are considerably degraded.

On the other hand, as described in the above, the embodiments 1 through 3 each use proper organometallic compound and perform calcination process in hydrogen so that the organometallic compound is thermally decomposed and carbon contained therein can be burned off previously (i.e., carbon content can be reduced). Especially, by setting calcination temperature to a range between 200 and 900 degrees Celsius, more preferably to a range between 400 and 900 degrees Celsius, carbon contained therein can be burned off more than required and carbon content remaining in the magnet after sintering can be restricted to the extent of less than 0.2 wt %, more preferably, less than 0.1 wt %. In the embodiments 1 through 3 where carbon content remaining in the magnet is less than 0.2 wt %, little carbide is formed in a sintering process, which avoids the problem such like the appearance of the considerable number of alpha iron phases 93 that can be observed in the comparative examples 2 and 3. Consequently, as shown in FIG. 9 through FIG. 13, the entirety of the respective permanent magnet 1 can be sintered densely through the sintering process. Further, considerable amount of alpha iron does not separate out in a main phase of the sintered magnet so that serious degradation of magnetic properties can be avoided. Still further, only Dy or Tb can be concentrated in grain boundaries in a selective manner, Dy or Tb contributing to improvement of coercive force. Thus, the present invention intends to reduce the carbon residue by means of thermal decomposition at a low temperature. Therefore, in view of the intention, as to-be-added organometallic compound, it is preferable to use a low molecular weight compound (e.g., the one consisting of an alkyl group of which carbon number is any one of integer numbers 2 through 6).

(Comparative Review of Embodiments and Comparative Examples Based on Conditions of Calcination Process in Hydrogen)

Figure 17:
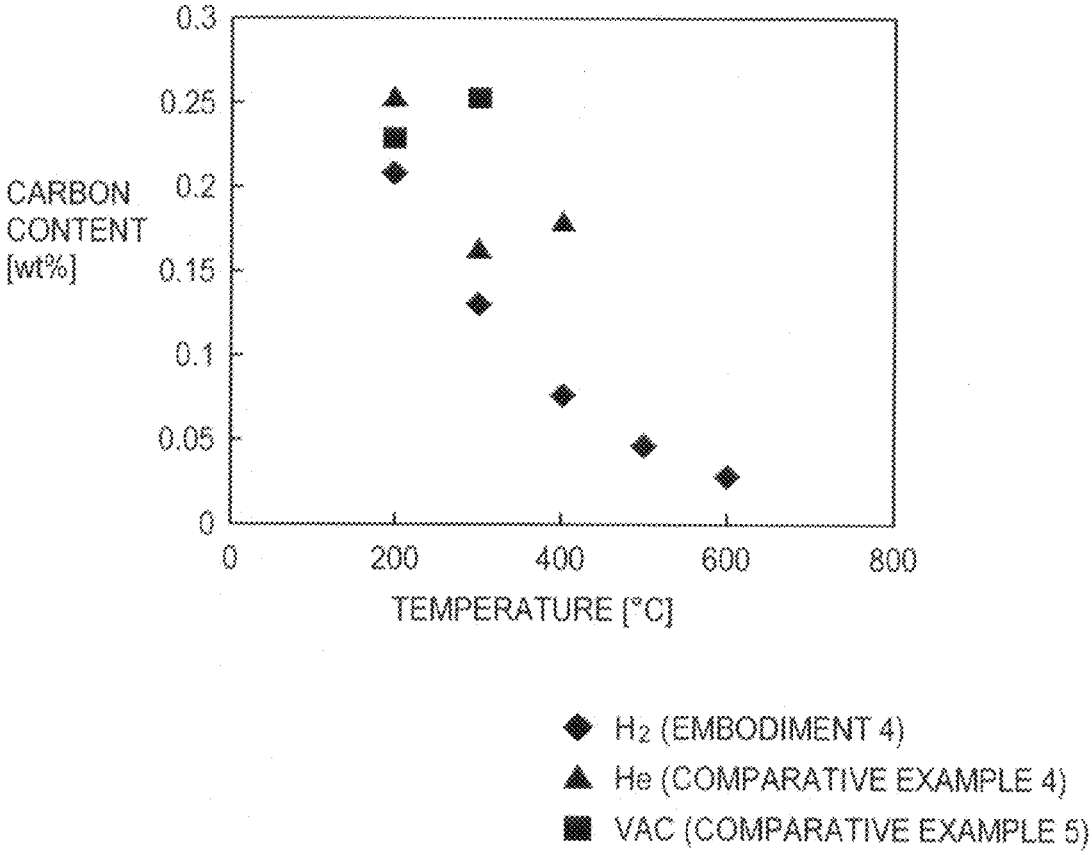
[FIG. 17] is a diagram of carbon content in a plurality of permanent magnets manufactured under different conditions of calcination temperature with respect to permanent magnets of embodiment 4 and comparative examples 4 and 5.

FIG. 17 is a diagram of carbon content [wt %] in a plurality of permanent magnets manufactured under different conditions of calcination temperature with respect to permanent magnets of embodiment 4 and comparative examples 4 and 5. It is to be noted that FIG. 17 shows results obtained on condition feed rate of hydrogen and that of helium are similarly set to 1 L/min and held for three hours.

It is apparent from FIG. 17 that, in case of calcination in hydrogen atmosphere, carbon content in magnet particles can be reduced more significantly in comparison with cases of calcination in helium atmosphere and vacuum atmosphere. It is also apparent from FIG. 17 that carbon content in magnet particles can be reduced more significantly as calcination temperature in hydrogen atmosphere is set higher. Especially, by setting the calcination temperature to a range between 400 and 900 degrees Celsius, carbon content can be reduced less than 0.2 wt %.

In the above embodiments 1 through 4 and comparative examples 1 through 5, permanent magnets manufactured in accordance with [Second Method for Manufacturing Permanent Magnet] have been used. Similar results can be obtained in case of using permanent magnets manufactured in accordance with [First Method for Manufacturing Permanent Magnet].

As described in the above, with respect to the permanent magnet 1 and the manufacturing method of the permanent magnet 1 directed to the above embodiments, an organometallic compound solution is added to fine powder of milled neodymium magnet material so as to uniformly adhere the organometallic compound to particle surfaces of the neodymium magnet powder, the organometallic compound being expressed with a structural formula of $M-(OR)_x$ (M represents Dy or Tb, R represents a substituent group consisting of a straight-chain or branched-chain hydrocarbon and $_x$ represents an arbitrary integer). Thereafter, a compact body formed through powder compaction is held for several hours in hydrogen atmosphere at 200 through 900 degrees Celsius for a calcination process in hydrogen. Thereafter, through vacuum sintering and pressure sintering, the permanent magnet 1 is manufactured. Owing to the above processes, even though amount of to-be-added Dy or Tb is made less in comparison with conventional one, Dy or Tb added thereto can be efficiently concentrated in grain boundaries of the magnet. Consequently, usage of Dy or Tb is reduced so that decline in residual magnetic flux density can be avoided and improvement of coercive force can be realized. Further, decarbonization is made easier when adding the above specified organometallic compound to magnet powder in comparison with when adding other organometallic compounds. Furthermore, such sufficient decarbonization can avoid decline in coercive force which is likely to be caused by carbon contained in the sintered magnet. Furthermore, owing to such sufficient decarbonization, the entirety of the magnet can be sintered densely.

Still further, Dy or Tb having high magnetic anisotropy is concentrated in grain boundaries of the sintered magnet. Therefore, coercive force can be improved by Dy or Tb, concentrated in the grain boundaries, preventing a reverse magnetic domain from generating in the grain boundaries. Further, since amount of Dy or Tb added thereto is less in comparison with conventional amount thereof, decline in residual magnetic flux density can be avoided.

Still further, the magnet to which organometallic compound has been added is calcined in hydrogen atmosphere so that the organometallic compound is thermally decomposed and carbon contained therein can be burned off previously (i.e., carbon content can be reduced). Therefore, little carbide is formed in a sintering process. Consequently, the entirety of the magnet can be sintered densely without making a gap between a main phase and a grain boundary phase in the sintered magnet and decline of coercive force can be avoided. Further, considerable alpha iron does not separate out in the main phase of the sintered magnet and serious deterioration of magnetic properties can be avoided.

Still further, as typical organometallic compound to be added to magnet powder, it is preferable to use an organometallic compound consisting of an alkyl group, more preferably an alkyl group of which carbon number is any one of integer numbers 2 through 6. By using such configured organometallic compound, the organometallic compound can be thermally decomposed easily at a low temperature when the magnet powder or the compact body is calcined in hydrogen atmosphere. Thereby, the organometallic compound in the entirety of the magnet powder or the compact body can be thermally decomposed more easily.

Still further, in the process of calcining the magnet powder of the compact body, the compact body is held for predetermined length of time within a temperature range between 200 and 900 degrees Celsius, more preferably, between 400 and 900 degrees Celsius. Therefore, carbon contained therein can be burned off more than required.

As a result, carbon content remaining after sintering is less than 0.2 wt %, more preferably, less than 0.1 wt %. Thereby, the entirety of the magnet can be sintered densely without occurrence of a gap between a main phase and a grain boundary phase and decline in residual magnetic flux density can be avoided. Further, this configuration prevents considerable alpha iron from separating out in the main phase of the sintered magnet so that serious deterioration of magnetic characters can be avoided.

In the second manufacturing method, calcination process is performed to the powdery magnet particles, therefore the thermal decomposition of the organometallic compound can be more easily performed to the whole magnet particles in comparison with a case of calcining compacted magnet particles. That is, it becomes possible to reliably decrease the carbon content of the calcined body. By performing dehydrogenation process after calcination, activity level is decreased with respect to the calcined body activated by the calcination process. Thereby, the resultant magnet particles are prevented from combining with oxygen and the decrease in the residual magnetic flux density and coercive force can also be prevented.

Still further, the dehydrogenation process is performed in such manner that the magnet powder is held for predetermined length of time within a range between 200 and 600 degrees Celsius. Therefore, even if $NdH_3$ having high activity level is produced in an Nd based magnet that has undergone calcination process in hydrogen, all the produced $NdH_3$ can be changed to $NdH_2$ having low activity level.

Not to mention, the present invention is not limited to the above-described embodiment but may be variously improved and modified without departing from the scope of the present invention.

Further, of magnet powder, milling condition, mixing condition, calcination condition, dehydrogenation condition, sintering condition, etc. are not restricted to conditions described in the embodiments.

Further, in the embodiments 1 through 4, dysprosium n-propoxide, dysprosium ethoxide or terbium ethoxide is used as Dy-or-Tb-inclusive organometallic compound that is to be added to magnet powder. Other organometallic compounds may be used as long as being an organometallic compound that satisfies an expression of $M-(OR)_x$ (M represents Dy or Tb, R represents a substituent group consisting of a straight-chain or branched-chain hydrocarbon, and $_x$ represents an arbitrary integer). For instance, there may be used an organometallic compound of which carbon number is 7 or larger and an organometallic compound including a substituent group consisting of carbon hydride other than an alkyl group.

EXPLANATION OF REFERENCES

1 permanent magnet
10 Nd crystal grain
11 Dy layer (Tb layer)
91 main phase
92 grain boundary phase
93 alpha iron phase

The invention claimed is:

1. A manufacturing method of a permanent magnet comprising steps of milling magnet material into magnet powder;

adding an organometallic compound expressed with a structural formula of $$M-(OR)_x,$$

M representing Dy or Tb, R representing a substituent group consisting of a straight-chain or branched-chain hydrocarbon, and $_x$ representing an arbitrary integer, to the magnet powder obtained at the step of milling magnet material and getting the organometallic compound adhered to particle surfaces of the magnet powder;

calcining the magnet powder of which particle surfaces have got adhesion of the organometallic compound in hydrogen atmosphere so as to obtain a calcined body of which carbon residue is reduced in comparison with before calcining the magnetic powder, wherein the step of calcining causes thermal decomposition of the organometallic compound and removes R so as to reduce carbon residue;

performing a dehydrogenation process by applying heat to the calcined body in vacuum atmosphere so that activity level is decreased with respect to the calcined body activated in the step of calcining the magnetic powder;

compacting the calcined body after the dehydrogenation process so as to obtain a compact body; and sintering the compact body, wherein carbon residue after sintering is under 0.2 wt %, and wherein, in the step of calcining the magnet powder, the magnet powder is held for a predetermined length of time within a temperature range higher than 600° C. and equal to or lower than 900° C.

2. The manufacturing method of a permanent magnet according to claim 1, wherein R in the structural formula is an alkyl group.

3. The manufacturing method of a permanent magnet according to claim 2, wherein R in the structural formula is an alkyl group of which carbon number is any one of integer numbers 2 through 6.

4. The manufacturing method of a permanent magnet according to claim 1, wherein, in the step of performing the dehydrogenation process, the magnet powder is held for predetermined length of time in vacuum atmosphere within a temperature range between 200 and 600 degrees Celsius.

* * * * *